US010427020B2

(12) United States Patent
Neale et al.

(10) Patent No.: US 10,427,020 B2
(45) Date of Patent: Oct. 1, 2019

(54) BASKETBALL SHOT TRAINING DEVICE

(71) Applicants: Tucker Neale, Strongsville, OH (US); Scott E. Urban, University Heights, OH (US); Paul R. Metcalfe, Solon, OH (US)

(72) Inventors: Tucker Neale, Strongsville, OH (US); Scott E. Urban, University Heights, OH (US); Paul R. Metcalfe, Solon, OH (US)

( * ) Notice: Subject to any disclaimer, the term of this patent is extended or adjusted under 35 U.S.C. 154(b) by 0 days.

(21) Appl. No.: 16/066,938

(22) PCT Filed: Nov. 8, 2016

(86) PCT No.: PCT/US2016/060936
§ 371 (c)(1),
(2) Date: Jun. 28, 2018

(87) PCT Pub. No.: WO2017/123317
PCT Pub. Date: Jul. 20, 2017

(65) Prior Publication Data

US 2019/0022495 A1 Jan. 24, 2019

Related U.S. Application Data

(60) Provisional application No. 62/279,403, filed on Jan. 15, 2016.

(51) Int. Cl.

| | |
|---|---|
| ***A63B 69/00*** | (2006.01) |
| ***A63B 21/00*** | (2006.01) |
| ***A63B 71/14*** | (2006.01) |
| ***A63B 23/14*** | (2006.01) |
| ***A63B 24/00*** | (2006.01) |

(52) U.S. Cl.
CPC .... *A63B 69/0071* (2013.01); *A63B 21/00043* (2013.01); *A63B 21/00185* (2013.01); (Continued)

(58) Field of Classification Search
CPC ..... A63B 69/0071; A63B 21/4019; A63B 21/4021; A63B 21/4025; A63B 21/00043; (Continued)

(56) References Cited

U.S. PATENT DOCUMENTS 3,249,359 A * 5/1966 Goldberger ..... A63B 69/0059 473/205
3,581,312 A * 6/1971 Nickels ..... A63B 71/148 473/450

(Continued)

OTHER PUBLICATIONS

International Search Report and Written Opinion, dated Feb. 9, 2017, in connection with PCT/US2016/060936, filed Nov. 8, 2016.

*Primary Examiner* — Mitra Aryanpour
(74) *Attorney, Agent, or Firm* — Fay Sharpe LLP

(57) ABSTRACT

A training device for training a player to shoot a basketball. The device includes a plate member configured to engage at least a portion of a hand and wrist of a non-shooting hand of the player, at least one attachment member connected to the plate member and configured to secure the plate member to the non-shooting hand of the player, and a link strap connected at a first end to the plate member and having an aperture through which a wrist of a shooting hand of the player can be aligned. The non-shooting hand and the shooting hand are linked together such that the non-shooting hand is restricted from rotation relative to the shooting hand when the non-shooting hand and the shooting hand are placed in spaced relation on an associated basketball.

15 Claims, 12 Drawing Sheets

(52) U.S. Cl.
CPC ..... *A63B 21/4019* (2015.10); *A63B 21/4021* (2015.10); *A63B 21/4025* (2015.10); *A63B 23/14* (2013.01); *A63B 24/0003* (2013.01); *A63B 69/0059* (2013.01); *A63B 71/14* (2013.01); *A63B 2209/10* (2013.01); *A63B 2220/00* (2013.01); *A63B 2220/40* (2013.01); *A63B 2220/56* (2013.01); *A63B 2220/803* (2013.01); *A63B 2220/836* (2013.01); *A63B 2225/09* (2013.01); *A63B 2243/0037* (2013.01)

(58) Field of Classification Search
CPC ..... A63B 21/00185; A63B 23/14; A63B 24/0003; A63B 69/0059; A63B 71/14; A63B 2209/10; A63B 2220/00; A63B 2220/40; A63B 2220/56; A63B 2220/803; A63B 2220/836; A63B 2225/09; A63B 2243/0037
USPC ..... 473/422, 450, 458, 464, 56, 438, 446, 473/205
See application file for complete search history.

(56) References Cited

U.S. PATENT DOCUMENTS 3,707,730 A * 1/1973 Slider ..... A41D 19/01582 473/450
4,377,284 A * 3/1983 Okerlin ..... A63B 69/0071 473/450
4,919,425 A * 4/1990 Wolf ..... A63B 69/0071 473/450
5,135,217 A * 8/1992 Swain ..... A63B 69/0071 473/450
5,188,356 A * 2/1993 Furr ..... A63B 69/0071 473/450
6,168,556 B1 * 1/2001 Saavedra ..... A63B 21/4019 482/105
6,223,353 B1 * 5/2001 Lardieri, Jr. ..... A41D 13/082 473/450
6,283,877 B1 * 9/2001 Cook ..... A63B 69/0059 473/438
7,399,240 B2 * 7/2008 Paukert ..... A63B 69/0071 128/878
D612,576 S * 3/2010 Toth ..... D2/617
8,096,901 B2 * 1/2012 Russotti ..... A63B 71/148 473/450
8,162,781 B2 * 4/2012 Heflin, Sr. ..... A63B 69/0071 473/448
8,414,430 B2 * 4/2013 McKinley ..... A63B 21/0555 473/450
2002/0077200 A1 * 6/2002 Kreutzer ..... A63B 69/0059 473/450
2006/0154753 A1 7/2006 Paukert et al.
2009/0318248 A1 12/2009 Russotti
2013/0310202 A1 11/2013 Griffee et al.

* cited by examiner

BASKETBALL SHOT TRAINING DEVICE

CROSS REFERENCE TO RELATED PATENTS AND APPLICATIONS

This application claims priority to and the benefit of the filing date of International Application No. PCT/US2016/060936, filed Nov. 8, 2016, which application claims priority to and the benefit of the filing date of U.S. Provisional Patent Application Ser. No. 62/279,403, filed Jan. 15, 2016, which application is hereby incorporated by reference.

BACKGROUND

The present invention relates to sporting equipment and more particularly to a basketball shooting aid that is worn on and near the hands of a player.

One typical technique for shooting a basketball includes propelling the ball with a primary shooting hand, and using the other hand (hereinafter referred to as the non-shooting hand) to stabilize and guide the ball until the ball is released during the shot. Often, young players have difficulty separating these functions between the two hands resulting in a potentially less accurate shot.

BRIEF DESCRIPTION

In accordance with one aspect of the present exemplary embodiment, a training device and method for training a player to shoot a basketball is disclosed. The device comprises a plate member configured to engage at least a portion of a hand and wrist of a non-shooting hand of the player, at least one attachment member connected to the plate member and configured to secure the plate member to the non-shooting hand of the player, and a link strap connected at a first end to the plate member and having an aperture through which a wrist of a shooting hand of the player can be aligned. The non-shooting hand and the shooting hand are linked together such that the non-shooting hand is restricted from rotation relative to the shooting hand when the non-shooting hand and the shooting hand are placed in spaced relation on an associated basketball.

The plate member can include opposite wing portions extending laterally from a wrist portion of the plate member, and the link strap can be secured at respective ends thereof to the respective opposite wing portions. The link strap can be attached to the plate member adjacent a bottom edge thereof. At least a portion of the link strap can be inelastic. The plate member can include a main portion and a thumb portion extending from the main portion, and the at least one attachment member can include a thumb strap configured to secure a thumb of the hand to the plate member such that movement of the thumb relative to the plate member is restricted. The thumb and wrist of the non-shooting hand can be secured to the plate member such that other fingers of the hand are free to move independent of the plate member. A resilient foam can be included on a surface of the plate member configured to engage the non-shooting hand. The link strap can include a resilient member, such as an o-ring, for adjusting a size of the aperture for engaging the shooting hand.

Data can also be obtained from one or more sensors associated with the device (and/or independent of the device) to determine a wide variety of shot metrics, such as the pressure placed on the palm of the shooting hand, position of the hands and/or elbows, pressure applied by one or more fingers and/or the palm of the hand, etc. In one embodiment, a sensor can be placed on the palm of the shooting hand to determine if the shooter is "palming" the ball or allowing for the proper amount of space between the ball and the palm of the hand without forcing the ball into an uncomfortable shooting position that can limit arc and adversely affect a shot. Data from such sensors (e.g., pressure sensors) can also be used to determine which fingers on the shooting hand are sharing the load of the work at the follow thru phase of the shot. In one shooting technique, the shooting hand middle and index finger should be the last two fingers to touch the ball as the ball is shot towards the rim. Typically, these same two fingers ultimately exert the most pressure on the ball during an optimal shot. Data can also be utilized to determine the position of one or both elbows. In general, the elbow of the shooting hand should be in to create the optimal flight pattern of the ball. A shot training device coupled with the aforementioned sensor technology enables monitoring each part of the shooting process for proper form.

DETAILED DESCRIPTION

It has been found that the proximity of the hands to one another during a shot is important, whereas when they are too far apart, and/or the hands are improperly rotated while supporting the ball and throughout shot release, the wrist position can become too distanced, which can contribute to poor shot mechanics and potentially a less accurate shot. Further, often, players learning to shoot or training to improve their shooting form use the non-shooting hand improperly, contributing to reduced shot accuracy. The non-shooting hand can adversely contact the ball in a manner which can interfere with the primary shooting hand's ball release. This can result in rotation about a non-horizontal axis. More specifically, in many players new to basketball, and/or learning to refine their skills using the proper form of basketball shooting, it is common for the non-shooting hand's thumb to protrude from the hand, commonly combined with rotation of the support hand's wrist, upon shot release. This results in the non-shooting hand's thumb rotating forward while contacting the ball, resulting in spinning the ball about a non-horizontal axis, resulting in a potentially less accurate shot.

Figure 1:
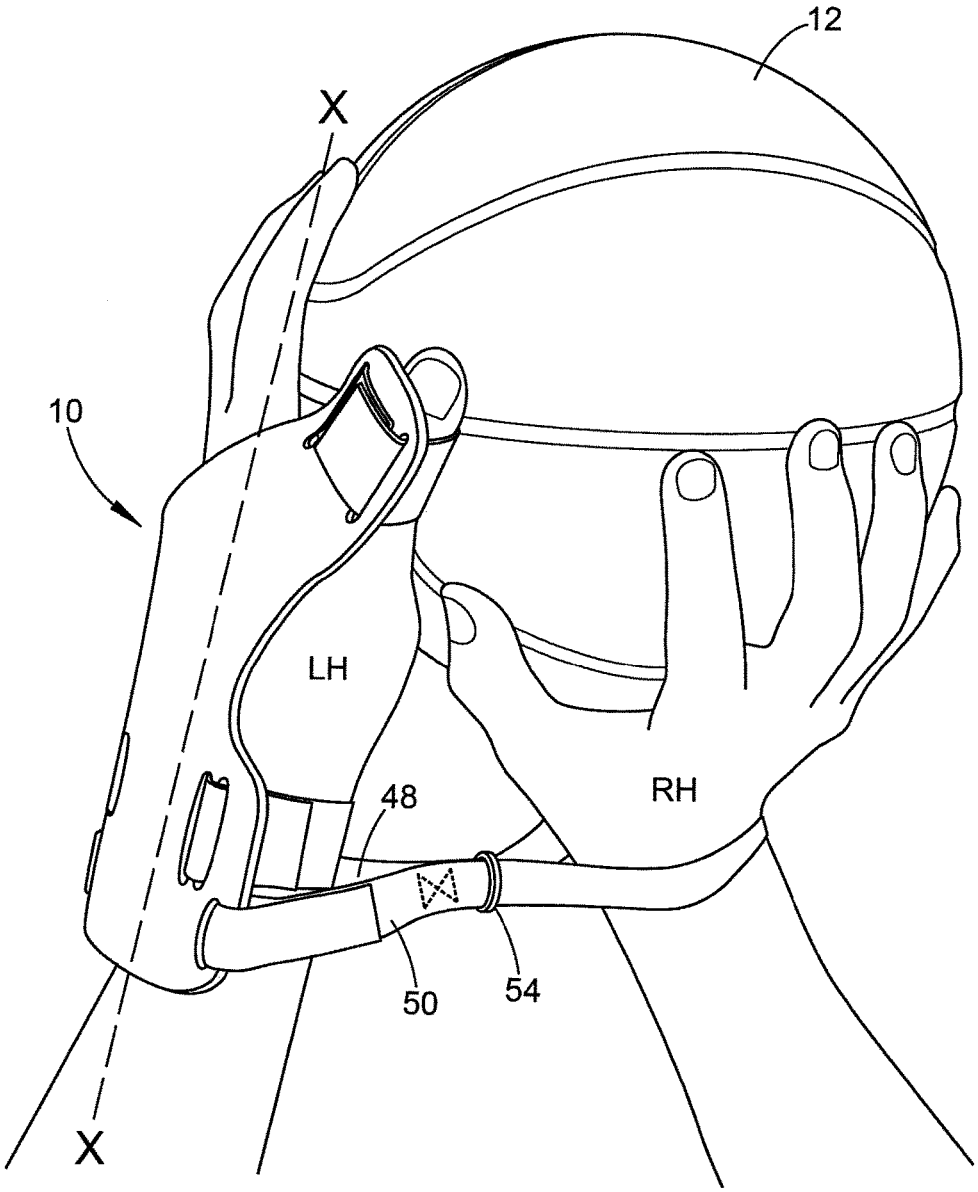
FIG. 1 is a perspective view of an exemplary training device in accordance with the present disclosure being worn by a shooter preparing to shoot a basketball.

Turning to FIGS. 1-12, and initially FIG. 1, an exemplary shot training device 10 in accordance with the present disclosure is illustrated positioned on a player's left hand LH (non-shooting hand) with a strap extending around the wrist of the right hand RH (shooting hand). The left hand LH and right hand RH are positioned on a basketball 12 in accordance with a typical shooting technique wherein the right hand is the shooting hand and the left hand is used for stabilizing the ball. The left hand LH in the exemplary embodiment is therefore positioned along a side of the basketball 12 while the right hand RH is positioned at the rear portion of the ball 12 (e.g., opposite the basket). It will be appreciated that the relative positions of the left hand LH and the right hand RH with respect to the ball conform to well-known shot techniques, and that the exemplary shot training device 10 enforces proper hand proximity.

In such well-known shot techniques, when shooting the basketball 12 the right hand RH is to be used for propelling the basketball 12 upwards and away from the shooter's body towards the basketball hoop. The left hand LH is merely used for stabilization of the basketball 12 and in general is not to be used for propelling the basketball 12 during the shot. Both hands may be used for aligning the shot prior to launch of the basketball 12 towards to basketball hoop.

As noted above, if the non-shooting hand, in this case the left hand LH, inadvertently imparts force to the basketball 12, such force generally results in an off horizontal axis spin which results in a less accurate shot. In addition, any such force must be accounted for by the shooting hand, thus significantly increasing the complexity of the shot. Accordingly, the shot training device 10 is configured to permit the shooting hand to generally operate freely to propel the basketball towards the basketball hoop while restricting the non-shooting hand from imparting shooting force and or rotation to the basketball 12. In addition, the attachment of the strap to the wrist of the shooting hand helps to encourage the user to position the elbow of the shooting arm roughly underneath the ball instead of flaring it outwards. The device purposefully does not restrict the motion of the fingers of the non-shooting hand nor does it prevent the palm of the non-shooting hand from curling inward away from the plate. This provides a more natural feel and allows the user to freely catch and handle the ball while using the device.

Figure 2:
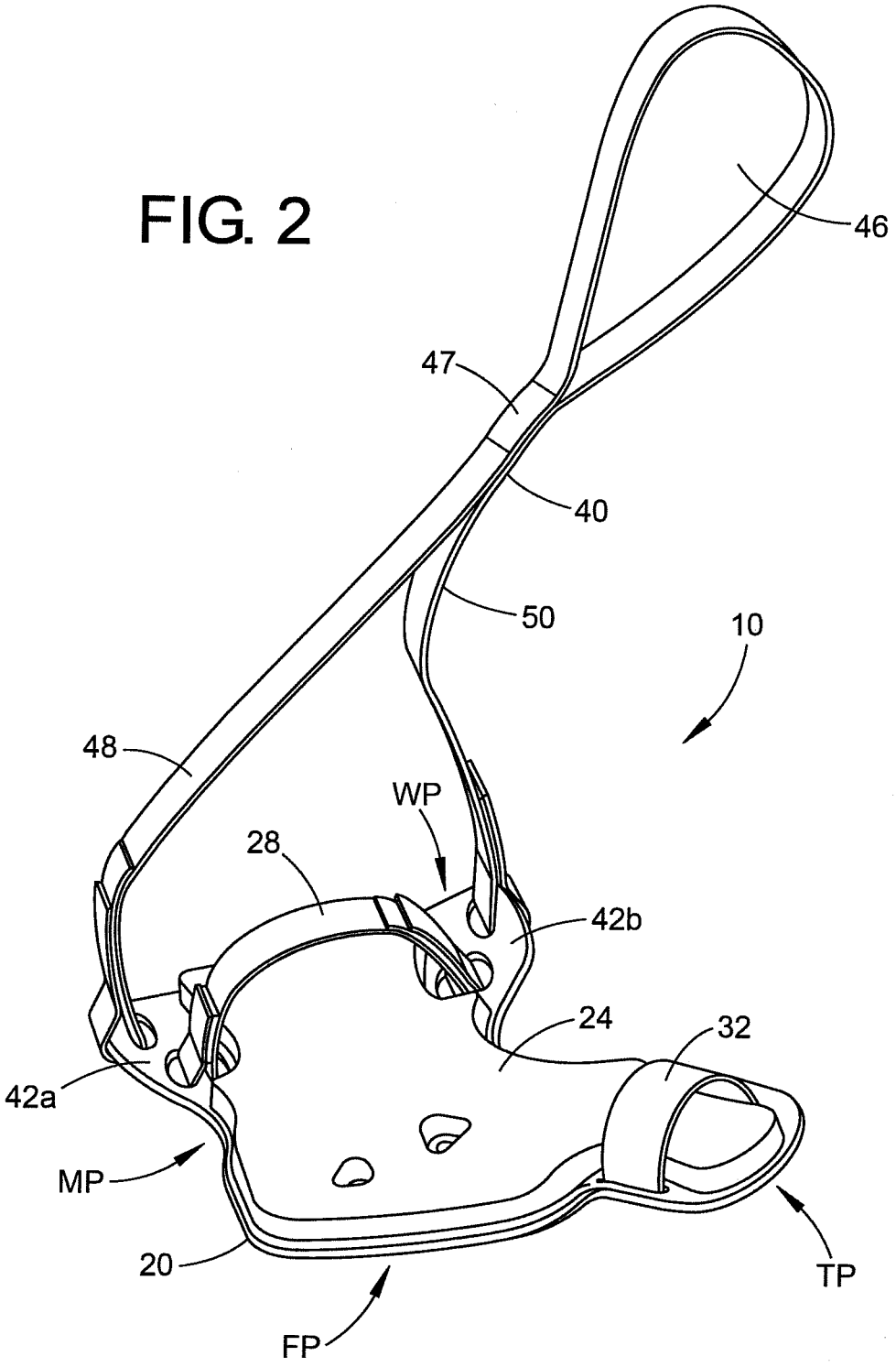
FIG. 2 is a perspective view of the exemplary training device.
Figure 3:
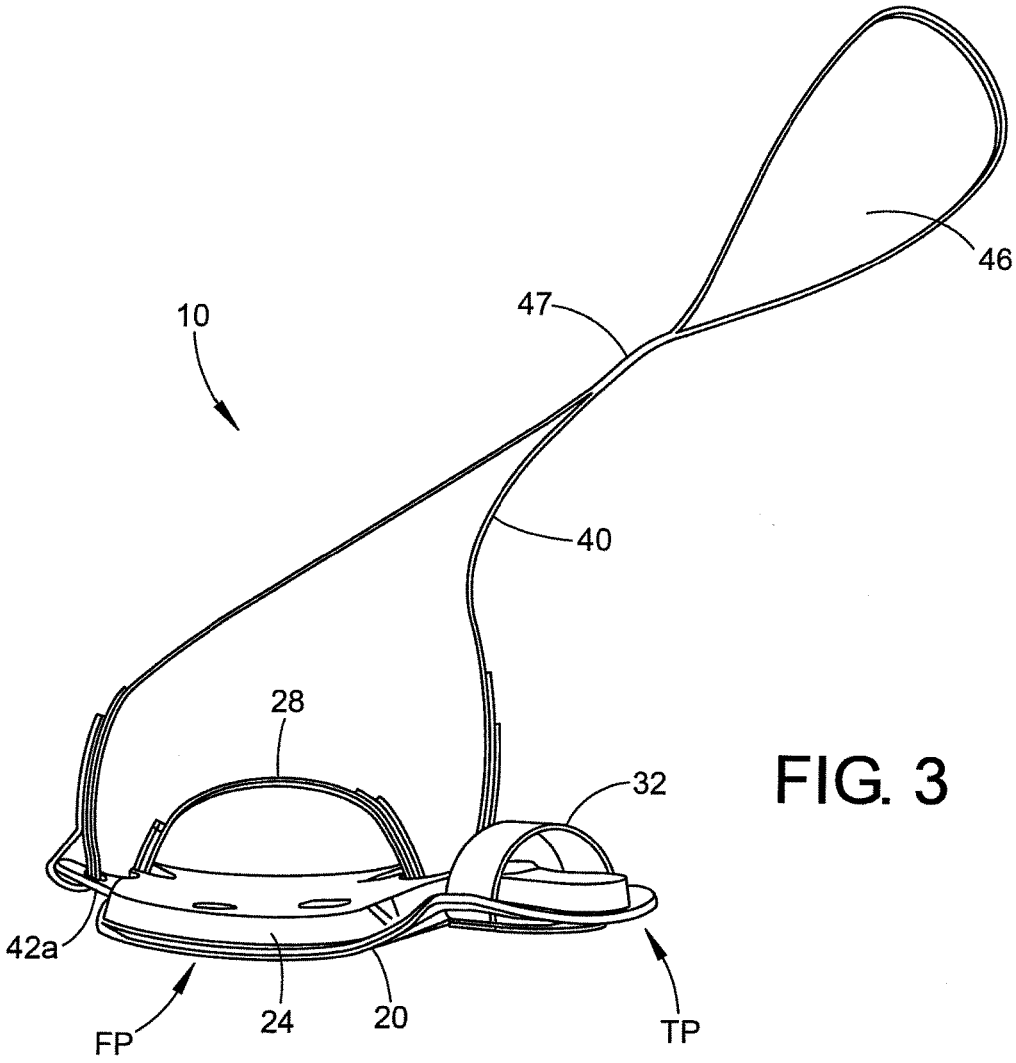
FIG. 3 is a front elevation view of the exemplary training device.
Figure 4:
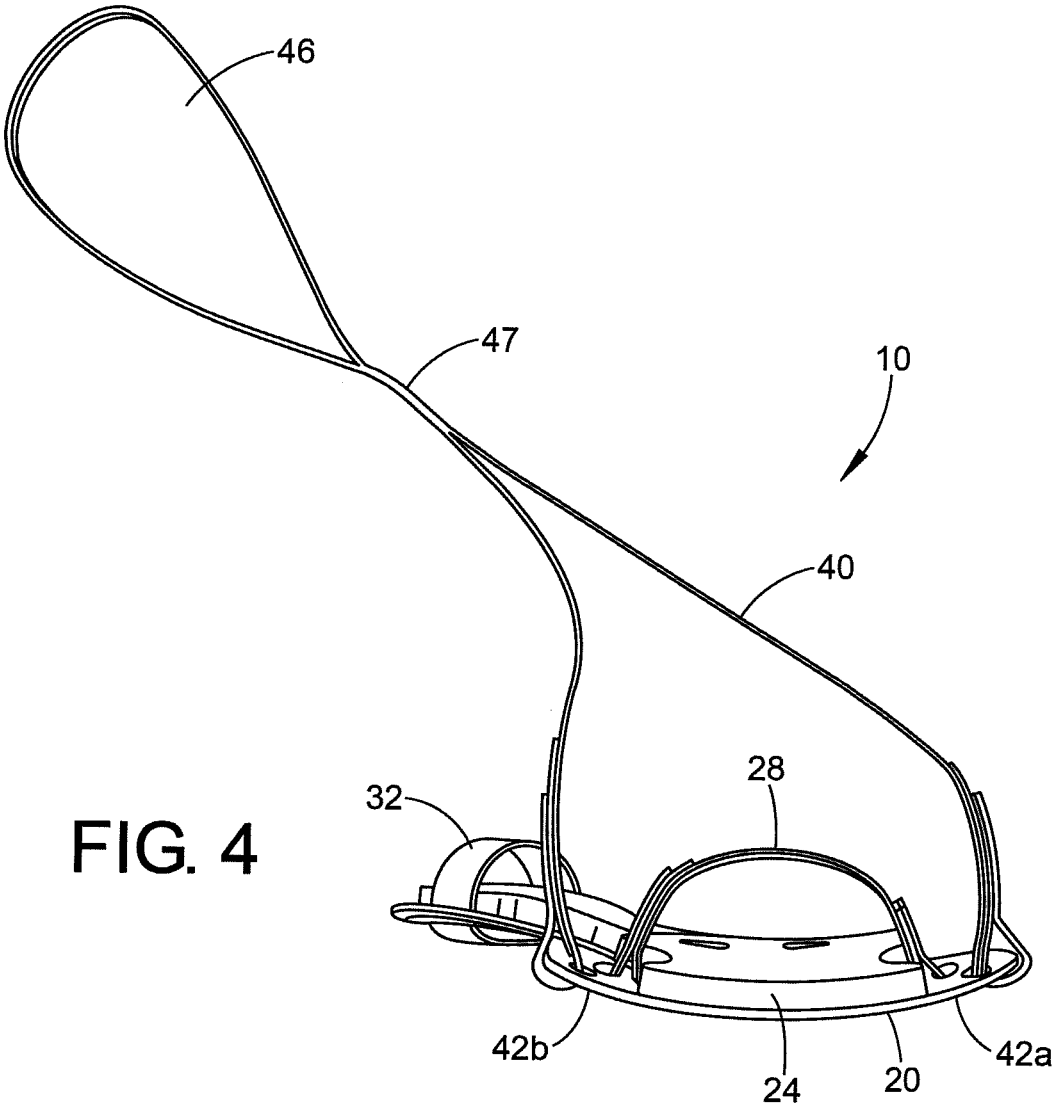
FIG. 4 is a rear elevation view of the exemplary training device.
Figure 5:
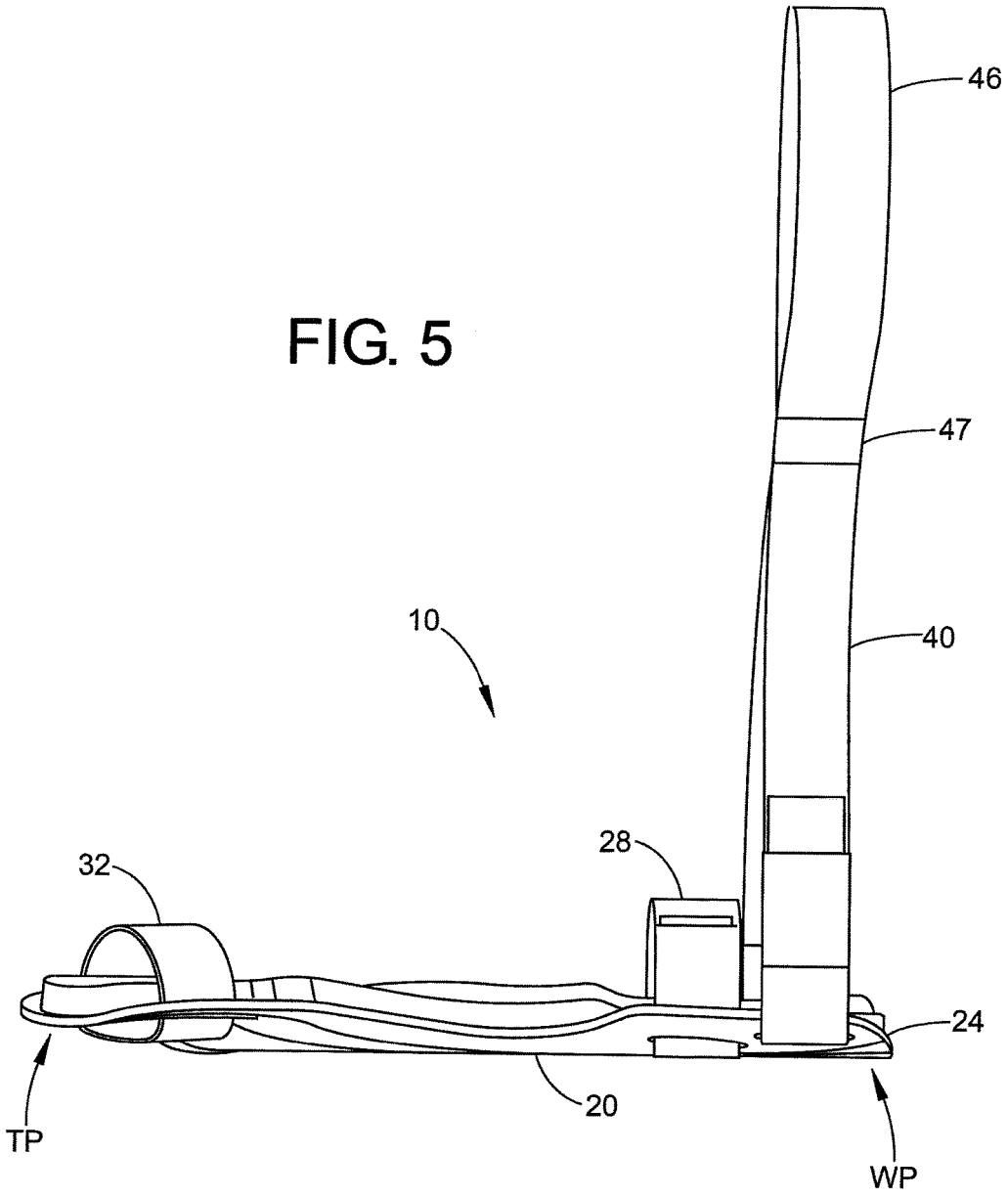
FIG. 5 is a first side elevation view of the exemplary training device.
Figure 6:
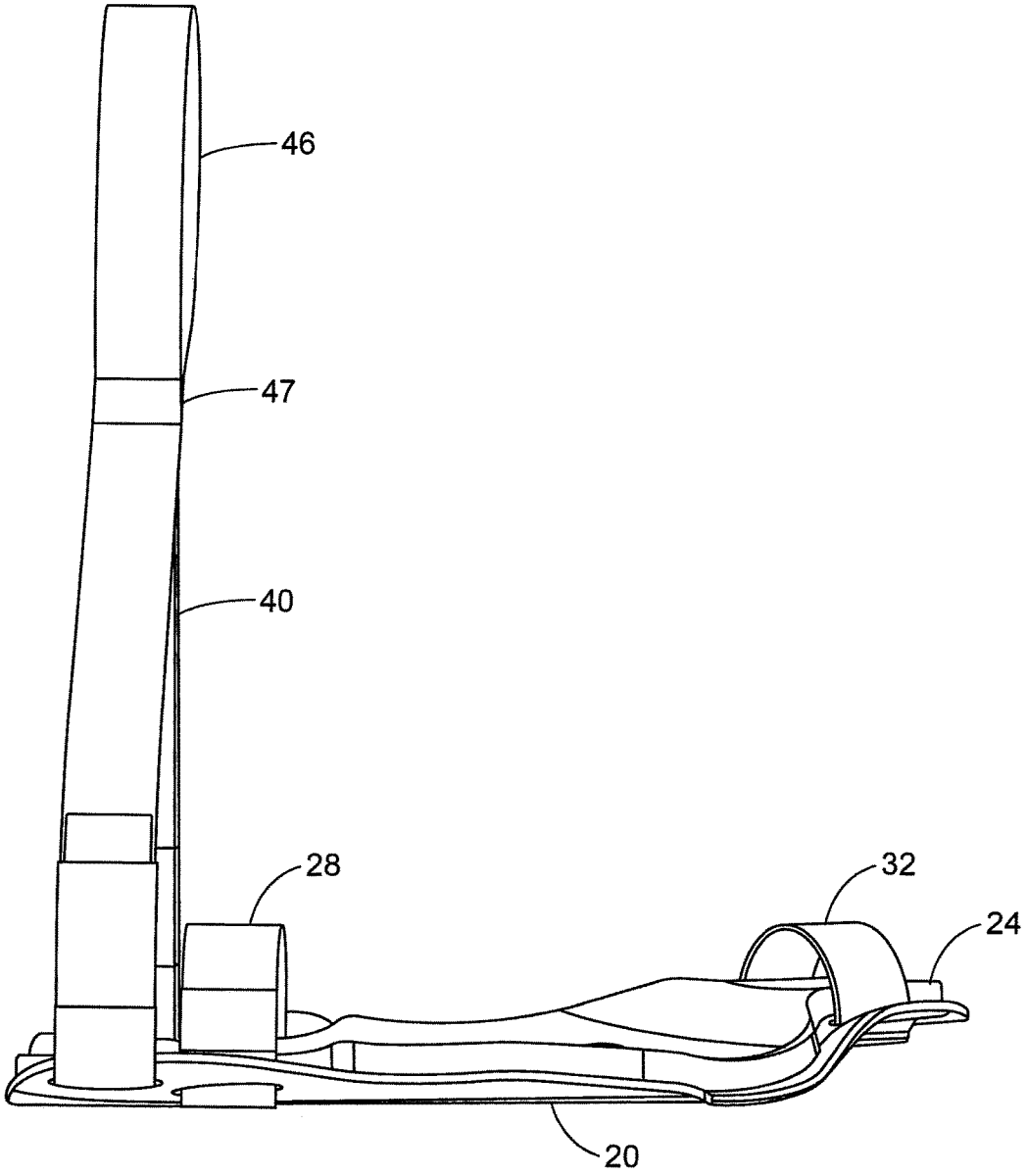
FIG. 6 is a second side elevation view of the exemplary training device.

Turning to the remaining figures, and initially FIG. 2, the basketball shot training device 10 generally comprises a contoured plate 20 adapted to be worn on the backside of a shooter's non-shooting hand and a plurality of straps configured to both attach the contoured plate 20 to the shooter's non-shooting hand and link the shooting hand to the non-shooting hand. The contoured plate 20 generally comprises a bottom side configured to face the top (e.g. back) of the user's non-shooting hand and a top side opposite the bottom side. A foam or other resilient material 24 is secured to the bottom side of the contoured plate 20. The foam 24 is configured to cushion the shooter's non-shooting hand during use of the shot training device 10 and also to provide a conforming fit to the back of the user's non-shooting hand. Various vent holes can also be provided as shown.

The shape of the contoured plate 20 is such that the foam 24 can generally have a consistent thickness across the bottom surface of the contoured plate 20. The contoured plate 20, therefore, is shaped to comfortably follow contours of the back of the non-shooting hand when in the general position shown in FIG. 1. The top side of the contoured plate 20 can include textured portions and non-textured portions. In some embodiments, the non-textured portions can be configured to include decals or other branding indicia. Generally speaking, the contoured plate 20 is concave such that it conforms to the generally convex shape of the back of a user's wrist and hand and at least partially wraps around the wrist and hand.

The contoured plate 20 further includes a thumb portion TP extending from a main portion MP of the contoured plate 20 for securement to the thumb of a user. This thumb portion TP is positioned on a level offset from the main portion of the device in order to reach the thumb in a natural position without having to deviate from the foam thickness found elsewhere. That is, the thumb portion changes elevation from the curvature of the back of the hand, as dictated by the shape of the plate to put the thumb in a natural position and enabling the foam to remain at a constant thickness throughout the underside of the plate. The contoured plate 20 further includes a main portion MP, a finger portion FP and a wrist portion WP.

The shot training device 10 includes both a wrist strap 28 and a thumb strap 32. These straps are located such that, in conjunction with the rigid plate, the thumb is prevented from bending, especially at its base joints. Wrist strap 28 and thumb strap 32 in the exemplary embodiment are elastic straps that are configured to stretch to permit a shooter to easily slide his hand into the shooting device 10. Each of the wrist strap 28 and the thumb strap 32 include cooperating hook and loop fasteners to allow simple assembly/connection of the straps to the contoured plate 20 and to permit adjustment of the length of each of the wrist strap 28 and thumb strap 32 to accommodate users of different sizes. Once a shooter adjusts the length of the respective straps, further adjustment of the straps is generally not needed thereby allowing a user to quickly and easily slide his or her hand into and out of the shooting device and securely fasten same thereto.

It will be appreciated that the wrist strap 28 and the thumb strap 32 are generally single straps having both the hook and loop fasteners or the like provided thereon such that tag end portions of each strap can be passed through an opening in the contoured plate 20 around a portion of the contoured plate 20 and back onto itself in a conventional manner. Of course, other manners of attaching the wrist strap 28 and the thumb strap 32 to the contoured plate 20 are also contemplated. For example, the straps may be permanently attached to the contoured plate 20 at ends thereof and provided with length adjustment at a central portion of the strap. In other embodiments, no adjustment may be provided and the elasticity of the straps themselves is sufficient for automatically accommodating different size hands and wrists. In such configuration, the lengths of the straps 28 and 32 may be chosen based upon an average size of a typical user.

Figure 7:
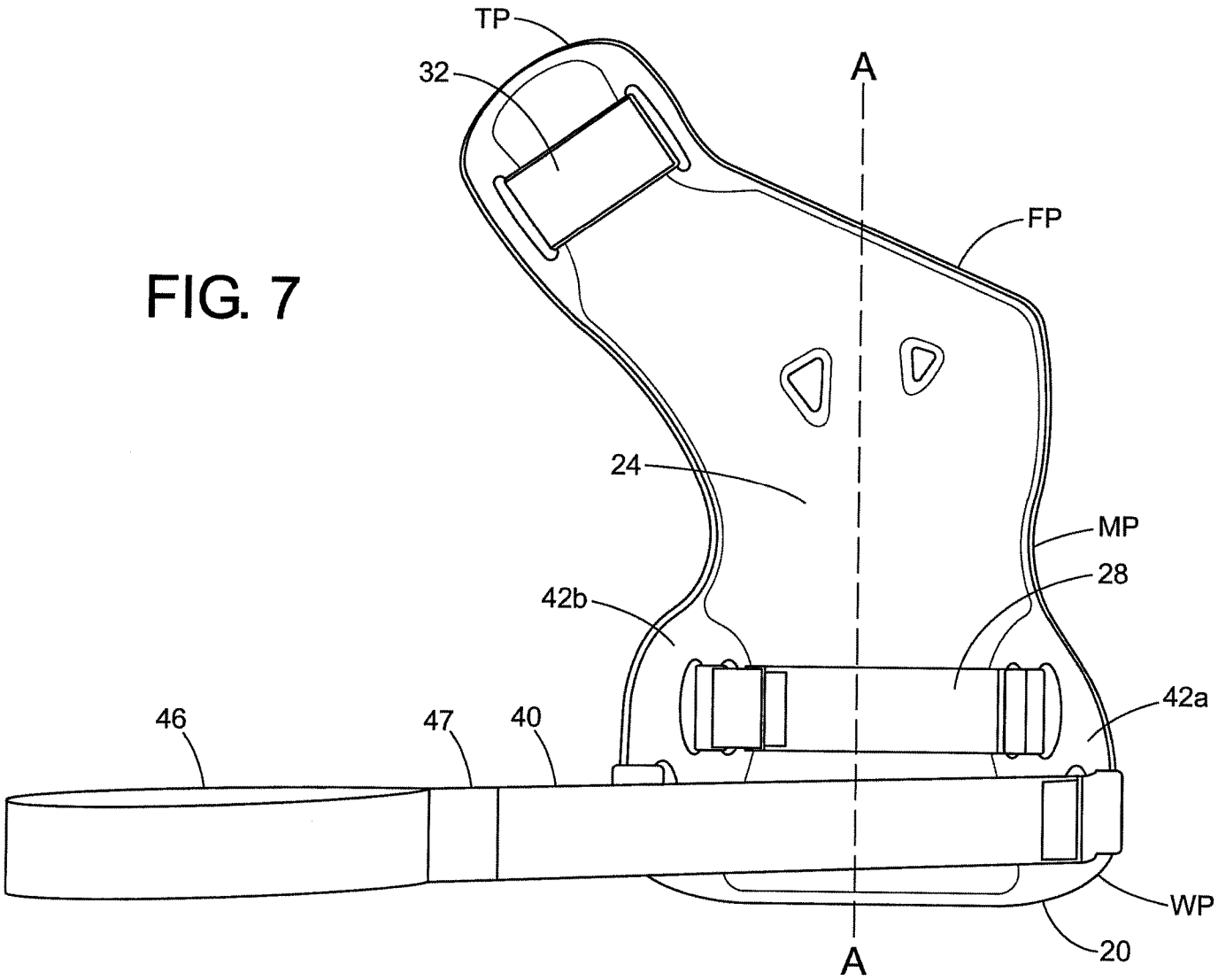
FIG. 7 is a plan view of a first side of the exemplary training device.
Figure 8:
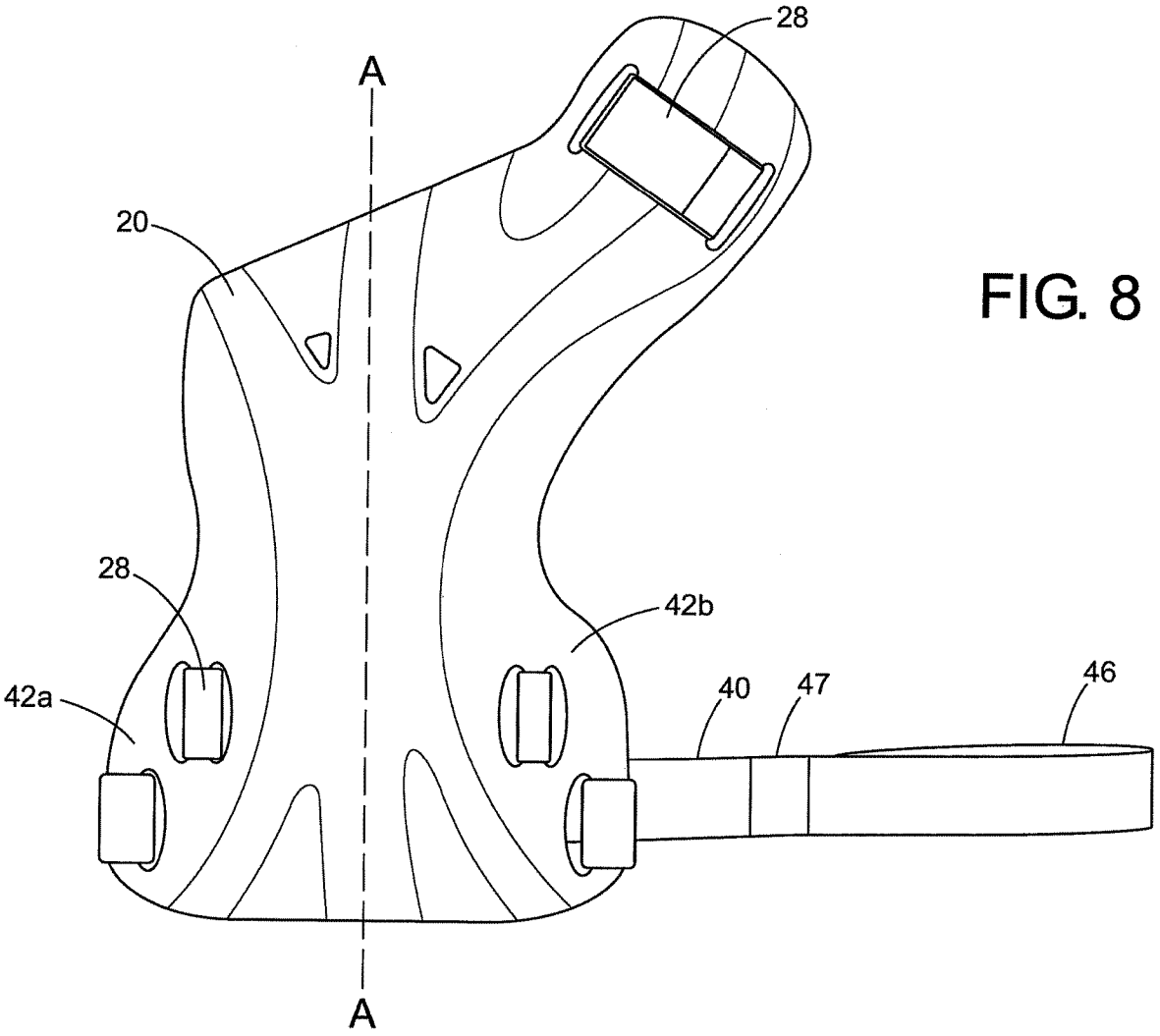
FIG. 8 is a plan view of a second side of the exemplary training device.
Figure 9:
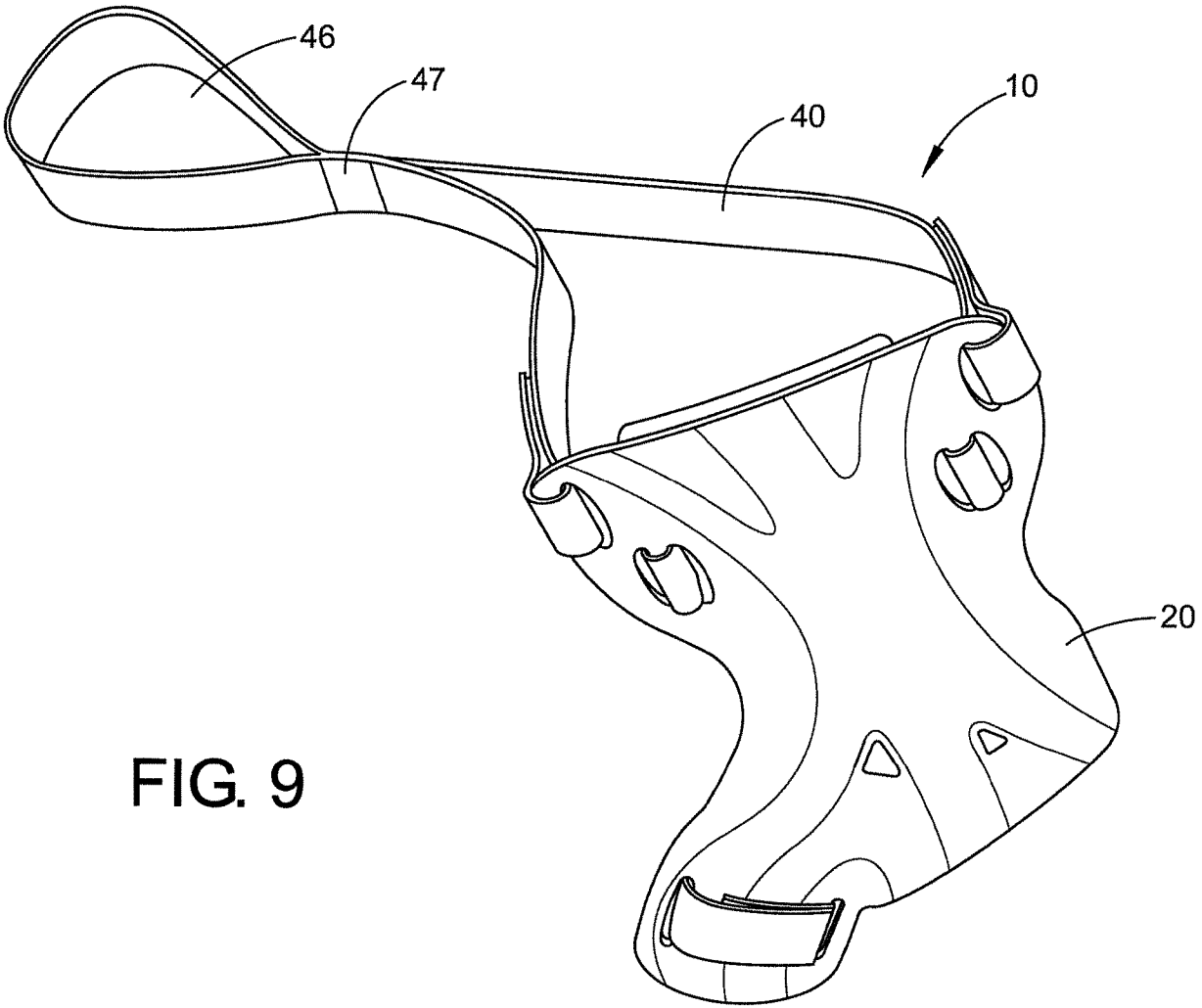
FIG. 9 is another perspective view of the exemplary training device.
Figure 10:
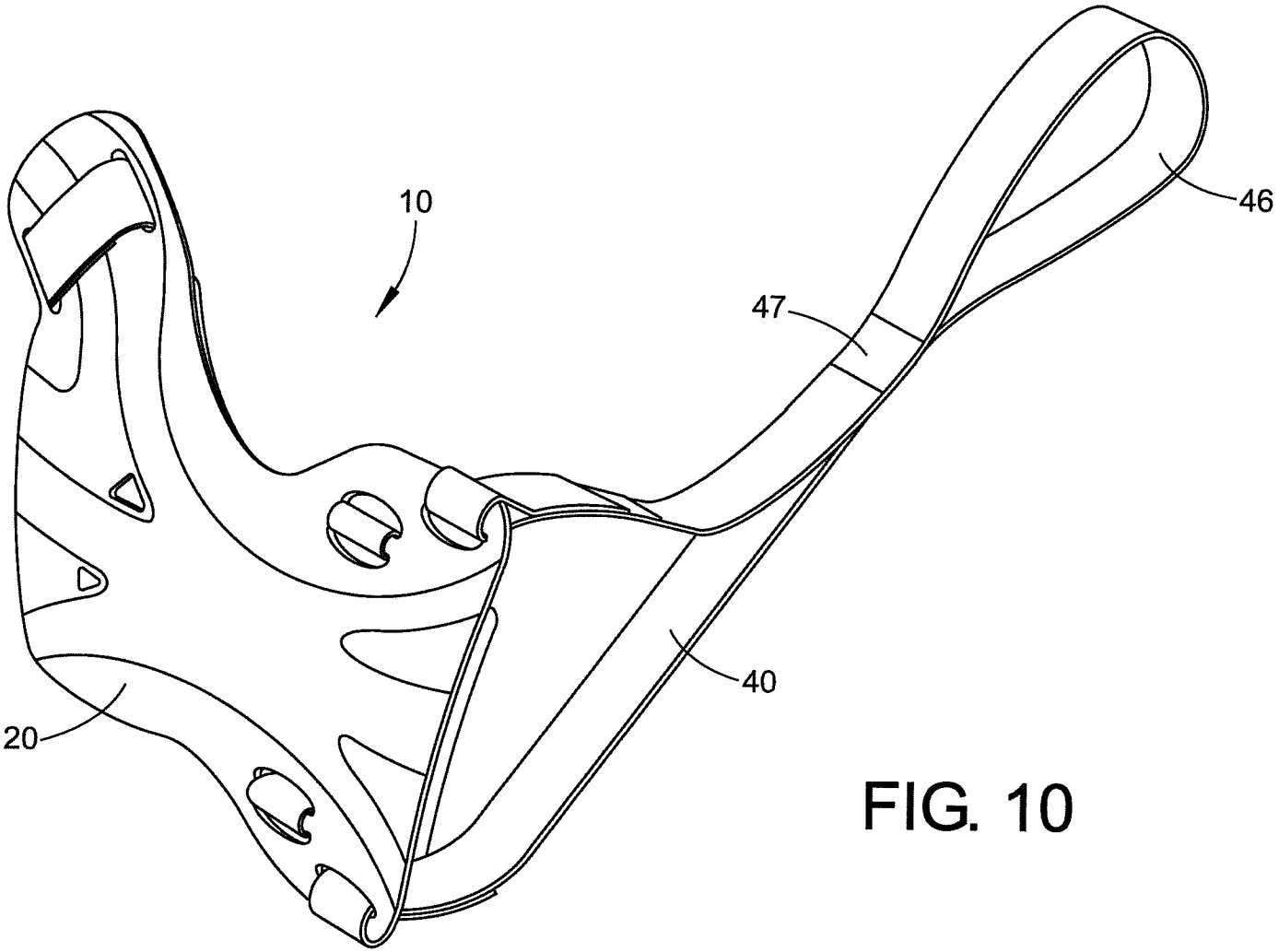
FIG. 10 is yet another perspective view of the exemplary training device.
Figure 11:
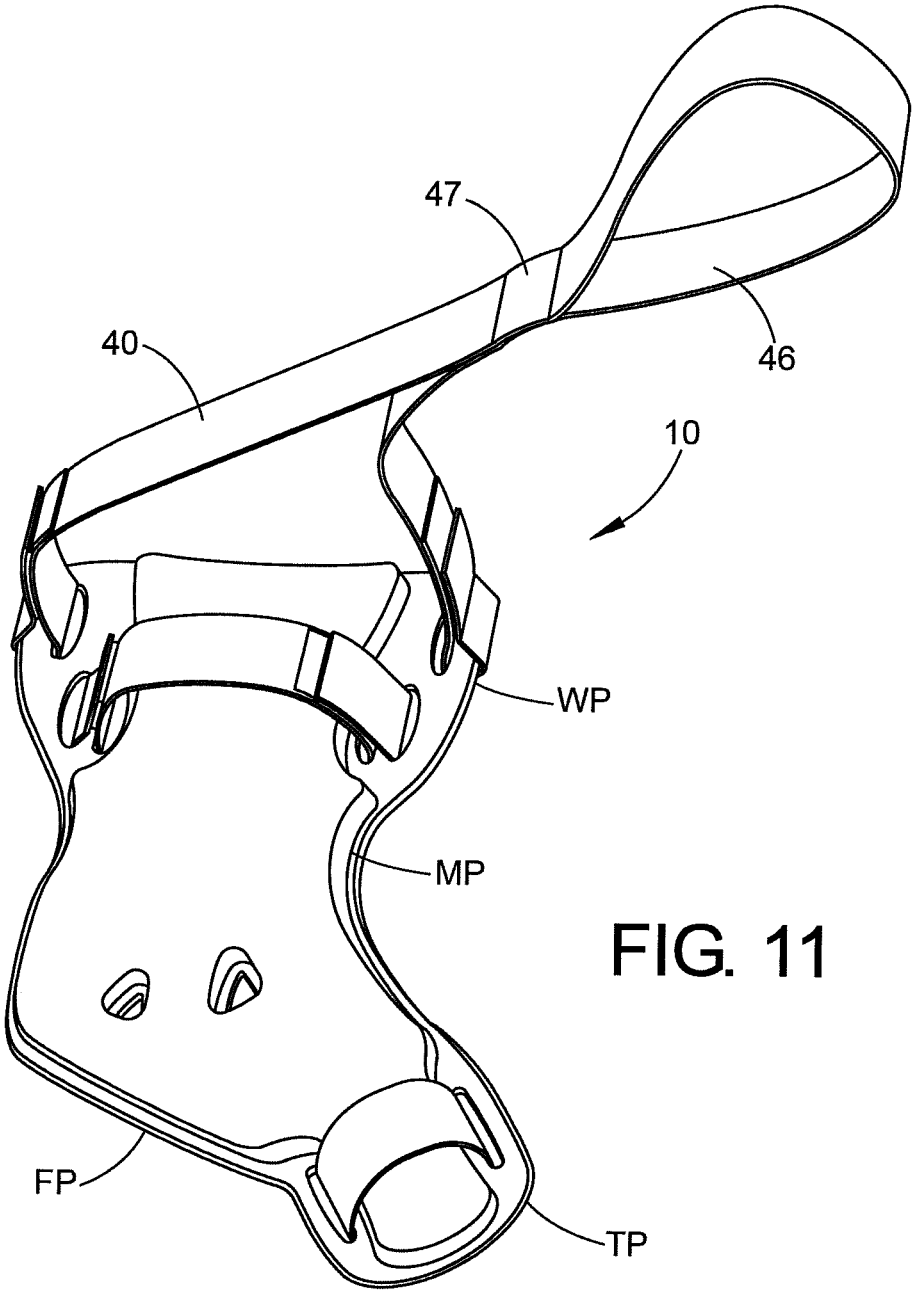
FIG. 11 is still yet another perspective view of the exemplary training device.
Figure 12:
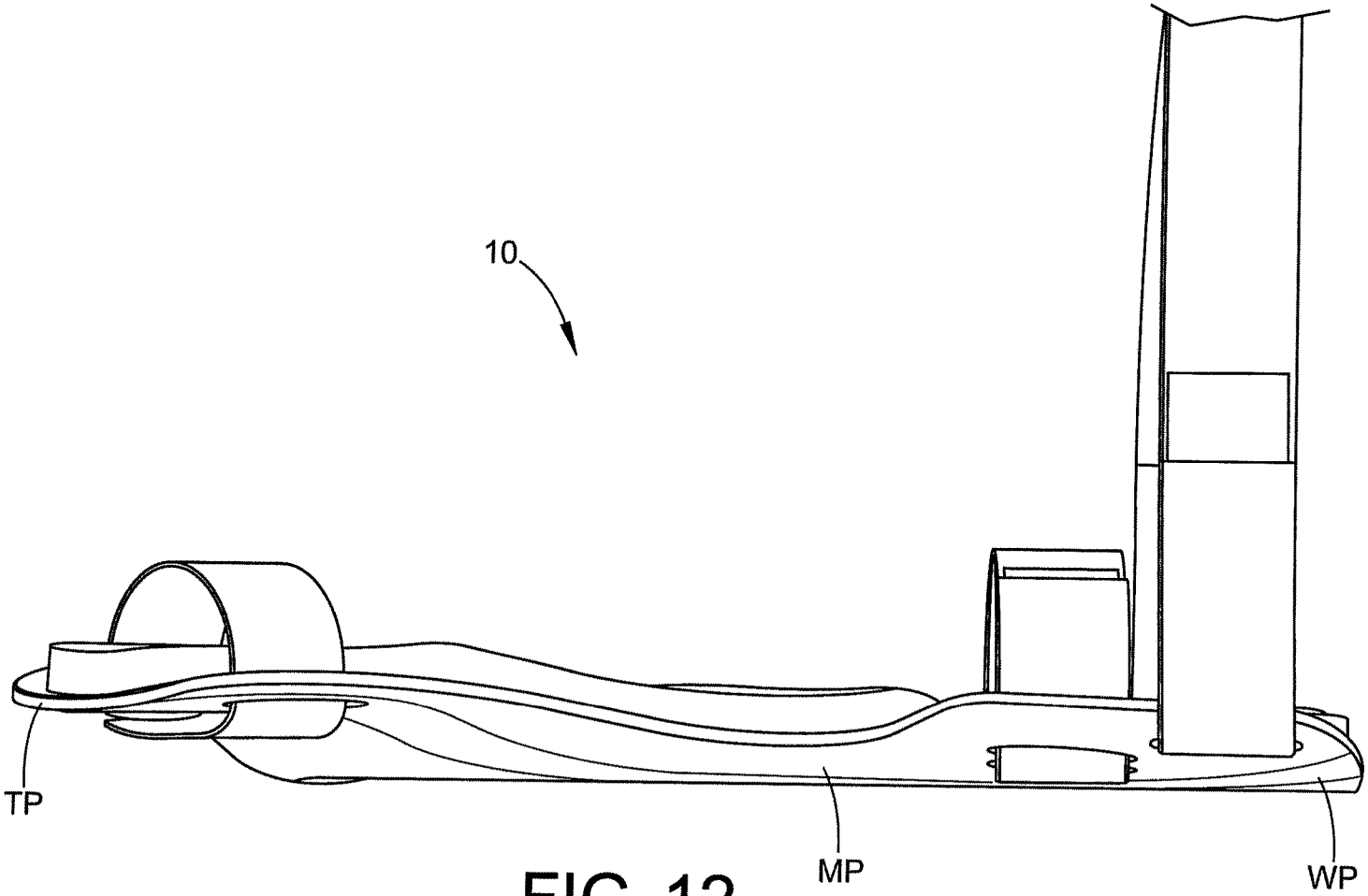
FIG. 12 is yet another perspective view of the exemplary training device.

In addition to the wrist strap 28 and the thumb strap 32, a link strap 40 is attached to the contoured plate 20 at respective locations outboard of the location of attachment of wrist strap 28. To this end, the contoured plate 20 includes a pair of outwardly extending wing portions 42*a* and 42*b*. As best seen in FIGS. 7 and 8, the wing portions 42*a* and 42*b* extend outboard of the points of attachment of the wrist strap 28 relative to axis A, generally adjacent a base portion of the plate opposite a finger portion FP of the plate 20. The wing portions 42*a* and 42*b* extend laterally beyond the side edges of the wrist portion WP of the plate 20. Attaching the link strap 40 to the contoured plate 20 in the locations shown in the FIGURES provides leverage to resist rotation of the contoured plate 20 and, consequently, the non-shooting hand during shooting, as will be described in more detail below.

The link strap 40 in the illustrated embodiment is generally made of an inelastic material (e.g., urethane coated polyester or nylon strapping or the like) and includes a distal wrist loop 46 for placement around the wrist of the shooting hand, such as shown in FIG. 1. The wrist loop 46 is generally formed by a looped portion of the link strap 40 that is connected by stitching 47 (or otherwise joined together) to form a closed loop. In the illustrated embodiment, tag ends 48 and 50 of the link strap 40 include hook and loop fasteners adapted to be passed through respective apertures in the wing portions 42*a* and 42*b* and folded back into engagement with each to secure the link strap to respective wing portions 42*a* and 42*b*. As used herein, the term tag ends refers to the portions of link strap 40 extending from the stitching 47 to the contoured plate 20.

Hook and loop fasteners on the tag ends 48 and 50 provide an amount of adjustment of the overall length of the link strap 40, as well as the relative lengths of the tag ends as measured from the stitching to the point of attachment to the contoured plate 20. For example, tag end 48 can be shorter or longer than tag end 50 depending on a particular application. In general, tag end 48 will generally be slightly shorter than the tag end 50 because tag end 48 prevents the wrist from turning in such a way as to have the thumb push the ball. Having the tag ends 48 and 50 equal in length is also possible. In generally, however, tag end 50 should not be shorter than tag end 48 since this may cause the wrist to rotate in the undesirable direction when the link strap 40 is pulled taut during use. It is generally preferable that the lengths of tag ends 48 and 50 are such that when link strap 40 is pulled taught the wrist is generally restricted from rotation in either direction.

As shown in FIG. 1, one or more O-rings 54 or other resilient member can be provided on the link strap 40 for adjusting the size of the wrist loop 46. The O-ring 54 offers an easily assemble-able design and a gentle cinching and light tightening of the strap portions that form wrist loop. This ensures it cannot be too tightly cinched around the wrist yet offers a simple, sufficient hold of the two strap portions near the wrist. The O-ring 54 can further provide an indicator that, if there is too much tension on the link between the two hands, the O-ring 54 or loop will slide away from the shooting hand towards the non-shooting hand. Marking lines or other like distance indicators can be placed visibly on the region of the strap near the wrist loop to observe the original position of the O-ring 54 before one or more shots. If there is little to no tension between the hands during shooting, the O-ring or loop would remain generally in the original position observed before the shot or shots. If the O-ring has slipped towards the non-shooting hand as compared to the original position observed before the shot or shots, too much tension has been applied to the link strap and the user is alerted to adjust his or her shooting form.

Returning to FIG. 1, it will now be appreciated that the shot training device 10, when properly positioned on the hands and wrist of a user, permits the shooting hand to freely propel the basketball towards the basketball hoop while restricting the non-shooting hand from rotating from the initial position and/or otherwise imparting force or spin to the basketball. This function is achieved because the tag ends 48 and 50 of the link strap 40 restrict rotation of the contoured plate 20 (e.g., rotation about axis X in FIG. 1). That is, tag end 50 restricts rotation of the thumb (and hand in general) to the left in FIG. 1, and tag end 48 restricts rotation of the thumb (and hand in general) to the right in FIG. 1.

In an alternative embodiment, a tracking system can be provided for tracking movement of and/or pressure applied by, one or more fingers of the user during use of the shooting aid. The tracking system can comprise one or more sensors in communication with a processing unit. The processing unit can be mounted or otherwise supported by the contoured plate 20 and/or a slip on glove or band or the like. The processing unit may include a power supply, and can be configured to gather and process data from the sensors and transmit said data to a user display or other device for further processing and/or analysis. In other embodiments, the sensors can communicate directly with, for example, a mobile phone or other processing unit located away from the hands, and interface with an application installed on the mobile phone or other processing unit. An electrical or mechanical spring scale sensor can be located along the link strap for indicating tension from attempted over-separation of the hands during the shooting process.

In an embodiment, a sensor can be placed on the shooting and supporting forearms to indicate their positions relative to the floor or playing surface. Considering the forearm as an axis, the forward and lateral leaning position could be detected and used to determine whether the shooter has achieved shooting mechanics in the desirable range which leads to better shooting accuracy.

In an embodiment, accelerometers and/or gyroscopic sensors placed at one or both of the hands, fingers, wrists, forearms, and elbows can generate data that can be interpreted as inside or outside a desirable range of metrics that contribute to increased shot accuracy as inputs towards shooting mechanics and behavioral change.

In one exemplary embodiment, pressure sensors are fitted to the fingertips of one or more fingers of at least one of the shooting hand and/or the non-shooting hand. Data relating to the amount and timing of pressure applied to the ball can be gathered and analyzed to confirm the shooting aid is effective in restricting inputs from the non-shooting hand.

It will be appreciated that realtime feedback can be provided to the user based at least in part on information obtained from the one or more sensors. The feedback can be positive or negative feedback. In one embodiment, audio, visual or tactile feedback can be provided to the user by one or more output devices. For example, an audio message from a recorded media such as a small electronic media storage chip can be broadcast instructing the user to correct a detected behavior. In one application, if the sensor data indicates that the user is pushing their elbows out (or detects some other undesirable movement) the audio message could be to "pull your elbow in", or "don't rotate your wrist or hand so much". Such feedback can be provided either in combination with a smart phone presentation or as an inexpensive means of audio presentation. In another configuration, the shot training device can include lights that illuminate when an undesired action is sensed. Vibration can also be used as another way to alert a user.

As used herein, the term shooting hand refers to the hand that is expected to deliver a majority of the shooting force to propel a ball towards a target. The term non-shooting hand refers to the hand that is not the shooting hand. It will be appreciated that the shooting hand may not provide all of the shooting force, and that the non-shooting hand may provide some shooting force. Thus, the use of the terms shooting hand and non-shooting hand have chosen for simplicity and clarity in describing the manner in which the device of the present disclosure is used. These terms do not limit the scope of the invention in any manner.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A training device for training a player to shoot a basketball, the device comprising:

a plate member configured to engage at least a portion of a hand and wrist of a non-shooting hand of the player;

at least one attachment member connected to the plate member and configured to secure the plate member to the non-shooting hand of the player;

a link strap connected at a first end to the plate member and having an aperture through which a wrist of a shooting hand of the player can be aligned;

wherein the plate member includes a main portion and a thumb portion extending from the main portion, and wherein the at least one attachment member includes a thumb strap configured to secure a thumb of the non-shooting hand to the plate member such that movement of the thumb relative to the plate member is restricted;

whereby the non-shooting hand and the shooting hand are linked together such that the non-shooting hand is restricted from rotation relative to the shooting hand when the non-shooting hand and the shooting hand are placed in spaced relation on an associated basketball.

2. The training device of claim 1, wherein the plate member includes opposite wing portions extending laterally from a wrist portion of the plate member, and the link strap is secured at respective ends thereof to the respective opposite wing portions.

3. The training device of claim 1, wherein the link strap is attached to the plate member adjacent a bottom edge thereof.

4. The training device of claim 1, wherein at least a portion of the link strap is inelastic.

5. The training device of claim 1, wherein only the thumb and wrist of the non-shooting hand is secured to the plate member such that other fingers of the hand are free to move independent of the plate member.

6. The training device of claim 1, further comprising a resilient foam on a surface of the plate member configured to engage the non-shooting hand.

7. The training device of claim 1, wherein the link strap includes a resilient member for adjusting a size of the aperture for engaging the shooting hand.

8. A method of using the device of claim 1, including securing the plate component to a non-shooting hand and linking a shooting hand to the non-shooting hand with the link strap placed around the wrist of the shooting hand.

9. A method of training a player to shoot a basketball, the method comprising:

providing a training device having:

a plate member configured to engage at least a portion of a hand and wrist of a non-shooting hand of the player;

at least one attachment member connected to the plate member and configured to secure the plate member to the non-shooting hand of the player; and a link strap connected at a first end to the plate member and having an aperture through which a wrist of a shooting hand of the player can be aligned;

securing the training device to the non-shooting hand of the player using the at least one attachment mechanism; and linking the plate member to the shooting hand with the link strap by looping the link strap around a wrist of the shooting hand;

wherein the plate member includes a main portion and a thumb portion extending from the main portion, and wherein the at least one attachment member includes a thumb strap configured to secure a thumb of the non-shooting hand to the plate member such that movement of the thumb relative to the plate member is restricted;

whereby the non-shooting hand and the shooting hand are linked together such that the non-shooting hand is restricted from rotation relative to the shooting hand when the non-shooting hand and the shooting hand are placed in spaced relation on an associated basketball.

10. The method of claim 9 wherein the plate member includes opposite wing portions extending laterally from a wrist portion of the plate member, and the link strap is secured at respective ends thereof to the respective opposite wing portions.

11. The method of claim 9, wherein the link strap is attached to the plate member adjacent a bottom edge thereof.

12. The method of claim 11, wherein at least a portion of the link strap is inelastic.

13. The method of claim 9, wherein only the thumb and wrist of the non-shooting hand are secured to the plate member such that other fingers of the hand are free to move independent of the plate member.

14. The method of claim 9, further comprising a resilient foam on a surface of the plate member configured to engage the non-shooting hand.

15. The method of claim 9, wherein the link strap includes a resilient member for adjusting a size of the aperture for engaging the shooting hand.

* * * * *